US008550211B2

(12) United States Patent
Higgins et al.

(10) Patent No.: US 8,550,211 B2
(45) Date of Patent: Oct. 8, 2013

(54) AERIAL WORK ASSEMBLY USING COMPOSITE MATERIALS

(75) Inventors: Daniel J. Higgins, Raleigh, NC (US); Jason Oakley, Kansas City, MO (US); Ryan McKinney, Parkville, MO (US)

(73) Assignee: Altec Industries, Inc., Creedmoor, NC (US)

( * ) Notice: Subject to any disclaimer, the term of this patent is extended or adjusted under 35 U.S.C. 154(b) by 396 days.

(21) Appl. No.: 12/284,572

(22) Filed: Sep. 23, 2008

(65) Prior Publication Data

US 2009/0101435 A1 Apr. 23, 2009

Related U.S. Application Data

(63) Continuation-in-part of application No. 11/055,346, filed on Feb. 10, 2005, now Pat. No. 7,748,496.

(51) Int. Cl.
*B66F 11/04* (2006.01)

(52) U.S. Cl.
USPC ..... 182/2.4; 182/2.1; 182/141; 182/142; 182/150

(58) Field of Classification Search
USPC ..... 182/2.1, 2.4, 141, 142, 150
See application file for complete search history.

(56) References Cited

U.S. PATENT DOCUMENTS 3,087,581 A 4/1963 Pitman
3,139,948 A * 7/1964 Rorden ..... 182/2.4
3,146,853 A * 9/1964 Eckels ..... 182/46
3,233,700 A * 2/1966 Myers ..... 182/2.4
3,295,633 A * 1/1967 Milner, Jr. ..... 182/222
3,380,554 A * 4/1968 Duryee ..... 182/46
3,554,319 A 1/1971 Smith et al.
3,590,948 A * 7/1971 Milner, Jr. ..... 182/2.1
3,625,305 A 12/1971 Mueller et al.
3,631,939 A 1/1972 Johnson et al.
3,642,096 A 2/1972 Valentine
3,690,408 A 9/1972 Reske et al.
3,699,851 A 10/1972 Kennedy
3,757,895 A 9/1973 Knutson
3,769,578 A 10/1973 Staley
3,828,941 A 8/1974 Coutinho
3,917,026 A * 11/1975 Hedges ..... 182/129
3,947,191 A 3/1976 Milner, Jr.
3,958,377 A 5/1976 Milner, Jr.
3,997,695 A 12/1976 Gitt et al.
4,044,856 A 8/1977 Stevenson
4,334,594 A * 6/1982 Jost ..... 182/2.1
4,411,070 A 10/1983 Boyum et al.
4,475,625 A 10/1984 Clements
4,534,444 A 8/1985 Smith
4,553,632 A 11/1985 Griffiths
4,653,654 A 3/1987 McDaniel, Jr. et al.
4,676,340 A 6/1987 Correll, Jr.
4,679,653 A 7/1987 Pasquarette, Jr. et al.
4,742,890 A 5/1988 de Blauw
4,763,755 A 8/1988 Murray
4,799,573 A 1/1989 Simnovec et al.
4,861,224 A * 8/1989 Holmes ..... 414/680
4,877,422 A 10/1989 Walbridge et al.
4,883,145 A 11/1989 Deltatto (Continued)

*Primary Examiner* — Katherine Mitchell
*Assistant Examiner* — Colleen M Chavchavadze
(74) *Attorney, Agent, or Firm* — Triangle Patents, PLLC

(57) ABSTRACT

An aerial work assembly including components having composite materials including a fabric-reinforced resin for providing electrically non-conductive assembly, by insulating and/or isolating conductive components.

8 Claims, 7 Drawing Sheets

COMPOSITE DESIGN

(56) References Cited

U.S. PATENT DOCUMENTS

| | | | | | |
|---|---|---|---|---|---|
| 4,917,214 | A | | 4/1990 | Mlaker et al. | |
| 4,946,003 | A | | 8/1990 | Walbridge | |
| 5,016,731 | A | | 5/1991 | Holmes | |
| 5,076,449 | A | * | 12/1991 | Clutter | 212/283 |
| 5,238,716 | A | | 8/1993 | Adachi | |
| 5,268,591 | A | | 12/1993 | Fujimoto | |
| 5,286,159 | A | | 2/1994 | Honma | |
| 5,538,207 | A | | 7/1996 | O'Connell et al. | |
| 5,560,730 | A | | 10/1996 | Gillard et al. | |
| 5,746,286 | A | | 5/1998 | Mlaker | |
| 6,085,505 | A | | 7/2000 | Edwards | |
| 6,105,723 | A | | 8/2000 | D'Alessio | |
| 6,170,607 | B1 | * | 1/2001 | Freeman et al. | 182/18 |
| 6,325,749 | B1 | | 12/2001 | Inokuchi et al. | |
| 6,379,023 | B1 | | 4/2002 | Passno | |
| 6,470,999 | B1 | | 10/2002 | Schanzle | |
| 2003/0213644 | A1 | | 11/2003 | Chard et al. | |
| 2004/0055817 | A1 | | 3/2004 | Chard et al. | |

* cited by examiner

PRIOR ART

SECTION VIEW

COMPOSITE DESIGN

SECTION VIEW: INSIDE THE BOOMTIP AREA OF AN AERIAL DEVICE USING COMPOSITE STRUCTURES TO ISOLATE/INSULATE CONDUCTION COMPONENTS

CONDUCTIVE COMPONENTS ARE ISOLATED OR INSULATED TO PREVENT ELECTRICAL CONTINUITY

AERIAL WORK ASSEMBLY USING COMPOSITE MATERIALS

CROSS-REFERENCE TO RELATED APPLICATIONS

This application claims the benefit of prior-filed U.S. patent application Ser. No. 11/055,346 filed Feb. 10, 2005 and is a continuation-in-part of that application, which is incorporated herein by reference in its entirety, including the figures and corresponding description.

BACKGROUND OF THE INVENTION

1. Field of the Invention

The present invention relates generally to vehicle mounted aerial devices, and more particularly to composite structural components of vehicle mounted aerial devices.

2. Description of the Prior Art

Vehicle mounted aerial devices have long been used for a variety of applications such as performing work on utility poles, trimming trees, maintaining street lights, and servicing overhead power and telephone lines. The aerial device normally includes a multiple-section boom which can either be an articulating boom or a boom that is extensible and retractable in telescoping fashion. The end of the upper boom is equipped with a personnel carrying device which is typically a platform, sometimes called a "bucket." The aerial work platform assembly consists of: the mounting brackets, platform, jib, the control assembly, control input mechanism and all other components at the end of the upper boom. This assembly is commonly referred to as the "boom tip" More than one platform may be attached to the end of the upper boom, and a platform may be large enough to carry one or more workers. Supplemental load lifting devices may also be installed on the boom near the platform in order to provide the aerial device with material lifting capabilities, in addition to its personnel lifting feature. The load lifting device is typically an adjustable jib, a winch, or a combination of both.

Typically, an aerial device broadly comprises a platform which serves as a work station for the operator; a movable boom; a vehicular base, such as a truck; a control input mechanism; and a control assembly. The platform is operable to lift or otherwise carry at least one worker to the elevated work site, and is coupled with the boom at or near a distal end thereof. Because the platform may be used near highly-charged electrical lines or devices, the platform is typically electrically isolated from the ground through the insulated booms and vehicle base so as to provide secondary protection against damaging electrical discharge or electrocution of the worker or bystanders. One component in isolating the platform occupant from ground through the booms and vehicular base is a non-conductive platform liner which provides some electrical isolation for the occupants lower extremities, as long as the lower extremities are contained entirely within the liner and in contact with nothing other than the liner.

The booms are movable so as to elevate and otherwise position the platform where desired, and are coupled with the vehicular base at or near a base end of the lower boom which is substantially opposite the distal end. The upper boom is constructed of an electrically non-conductive, or dielectric, material and provides secondary protection by preventing a path to ground through the booms and vehicular base. Commonly, in order to further electrically isolate the platform from electrical discharge via the boom and the vehicular base, an intermediate portion or section of the lower boom is constructed of or covered with an electrically non-conductive, or dielectric, material. The distal end of the boom or boom tip however, though electrically isolated from the vehicular platform, must incorporate structural material so as to have sufficient structural strength to support the platform and worker. This structural material is typically an electrically conductive metal, such as steel, with the steel, platform and control assembly being considered electrically connected. In addition to the boom assembly, various other parts at the end of boom are constructed from metals such as steel or aluminum and all components at the end of the boom must be considered electrically connected. The vehicular base is motorized and wheeled or otherwise adapted to quickly and efficiently travel to and from the work site. The vehicular base will either be in direct contact with an electrical ground, such as, for example, the Earth, or must be considered in direct or indirect contact therewith.

The control input mechanism allows the elevated worker to provide a control input to control, via the control assembly, movement of the boom and positioning of the platform. Commonly, the control assembly comprises one or more hydraulic control valves, one or more fluid conduits and a quantity of hydraulic fluid, to transmit the control input down the boom for implementation. The necessary conduit connections, however, prevent the control valves from being located inside the platform and its protective liner. Furthermore, as the control input mechanism must be in direct physical contact with the control assembly in order to actuate the valves in accordance with the control input, the control input mechanism without proper protective equipment must also be located outside the platform and protective liner. Thus, the worker may reach outside the protective liner to actuate the control input mechanism, thereby exposing him or herself to possible electrocution if they are working in the area of energized lines, contrary to federal safety regulations and employer safe practices. The control valves to which the control input mechanism is coupled are typically constructed of an electrically conductive material. Furthermore, the control valves may be located in close proximity to the aforementioned electrically conductive structural support material used to reinforce the distal end of the boom.

Thus, although the aforementioned dielectric boom portion does protect against electrical discharge via the boom and vehicular base, it does not protect against direct discharge via the electrically conductive structural material in the distal end of the boom, via the control valves, and via the control input mechanism. For example, a discharge path could be from an unprotected first conductor, to any component at the boom tip, to any other component at the boom tip, including the control input mechanism, to a worker not using rubber gloves, and to a second unprotected conductor. It will be appreciated that the dielectric boom portion provides no protection against this or similar discharge paths.

In order to minimize the risks of injury, the operator must always maintain safe clearances from electrical lines in accordance with applicable government regulations, such as those promulgated by the Occupational Safety and Health Agency (OSHA), and safe work practices adopted by the employer. Furthermore, if the possibility of electrical contact or proximity exists, operators must use proper protective equipment which provides primary protection from electrical injury. The aerial device will not provide protection from contact with or in proximity to an electrically charged power line when the operator or the components at the boom tip are in contact with or in proximity to another power line, ground, or pole. If such contact or proximity occurs, all components at the boom tip, including the controls, may become energized. It should be understood that no invention will completely prevent electrical accidents. However, the present invention provides greater protection than existing designs against electrical injury that may be sustained by a worker whose behavior does not conform to government regulations and safe work practices.

Therefore due to advances in technology and newly available materials, an opportunity now exists for an improved aerial work platform assembly that may better protect the worker against electrical discharge when regulations and safe practices are not followed. While various non-metals, such as rubber, plastic, and polymer materials might satisfy the dielectric requirement of the components in such an improved system, most of those materials are not suitable. The aerial work platform assembly components must be structurally rigid and durable, but cannot be overly bulky and cumbersome to manipulate. Thus, there remains a need for an aerial work platform assembly that maximizes the number of parts which are lightweight, structurally rigid, durable, and substantially nonconductive, in addition to being more cost effective than the construction of prior art assemblies.

SUMMARY OF THE INVENTION

A first aspect of the present invention is to provide a vehicle mounted aerial device formed of composite materials for providing electrically non-conductive platform, controls, and other components and isolated conductive components.

A second aspect of the present invention is to provide an aerial work assembly including components having composite materials including a fabric-reinforced resin for providing electrically non-conductive assembly, by insulating and/or isolating conductive components.

These and other aspects of the present invention will become apparent to those skilled in the art after a reading of the following description of the preferred embodiment when considered with the drawings, as they support the claimed invention.

DETAILED DESCRIPTION

Figure 1:
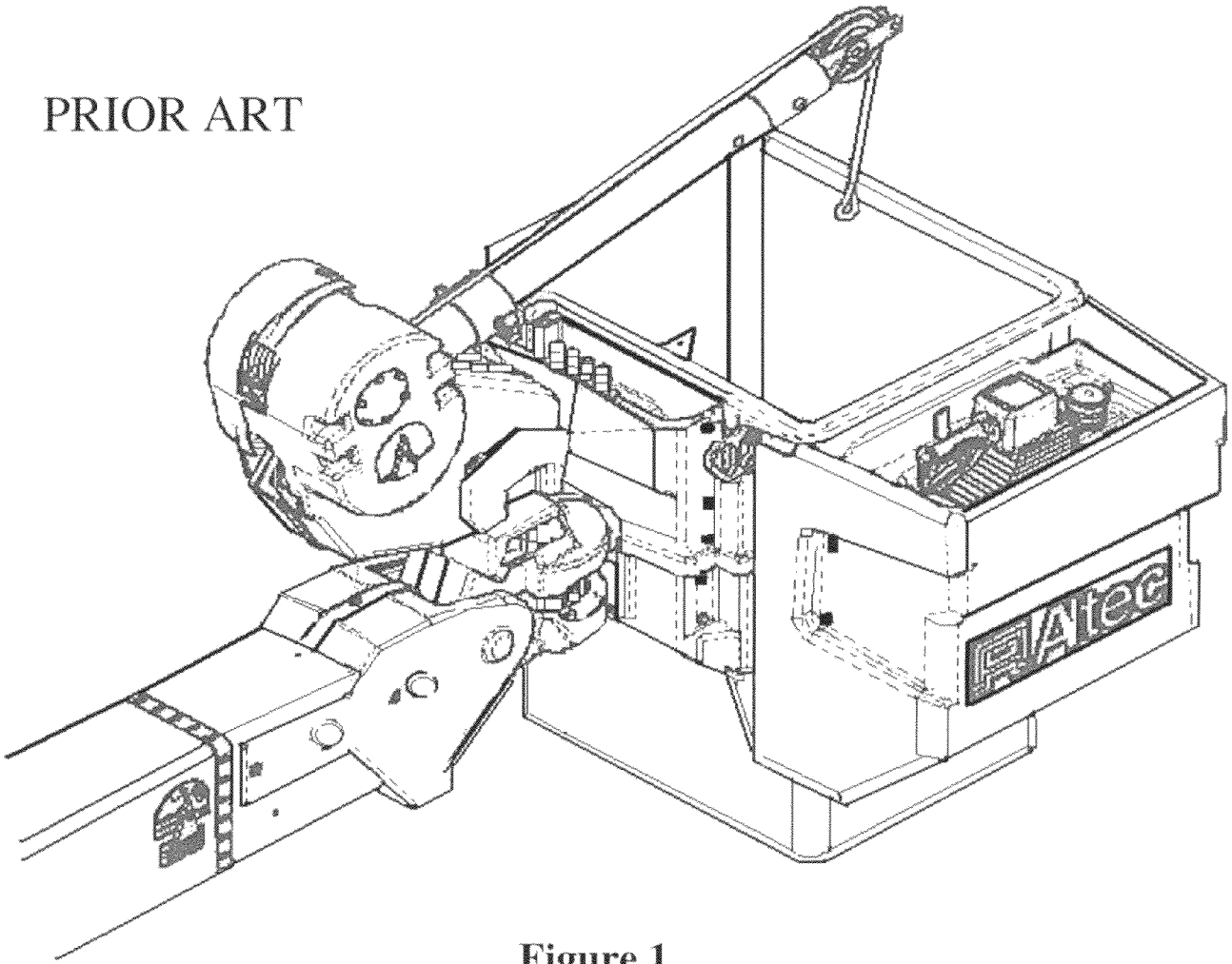
FIG. 1 shows a PRIOR ART perspective view of an aerial platform assembly.

Certain features which are used in assembling or operating the invention, but which are known to those of ordinary skill in the art and not bearing upon points of novelty, such as screws, bolts, nuts, welds, and other common fasteners, may not be shown for clarity. The following description focuses on a prior art configuration in some figures to illustrate differences and distinctions comparing the present invention thereto. It will be understood by one of ordinary skill in the art that many other variations of prior art aerial configurations may be equally suitable for use with the invention and its improvements thereto.

Referring now to the drawings in general, the illustrations are for the purpose of describing preferred embodiment(s) of the invention and are not intended to limit the invention thereto.

The present invention provides for composite components and other solutions to completely insulate and/or isolate conductive components on the vehicular aerial platforms including controls, connectors, and other functional components. Such structural and functional components, such as connectors, had to be redesigned in the present invention to function the same or similarly but still be simple enough to form a composite component. By contrast to the prior art, typically only the platform or the boom were constructed of composite materials, leaving many electrically conductive components exposed and/or in electrical conductive proximity to other conductive components, thereby creating an unsafe configuration for a person working on the platform.

Figure 2:
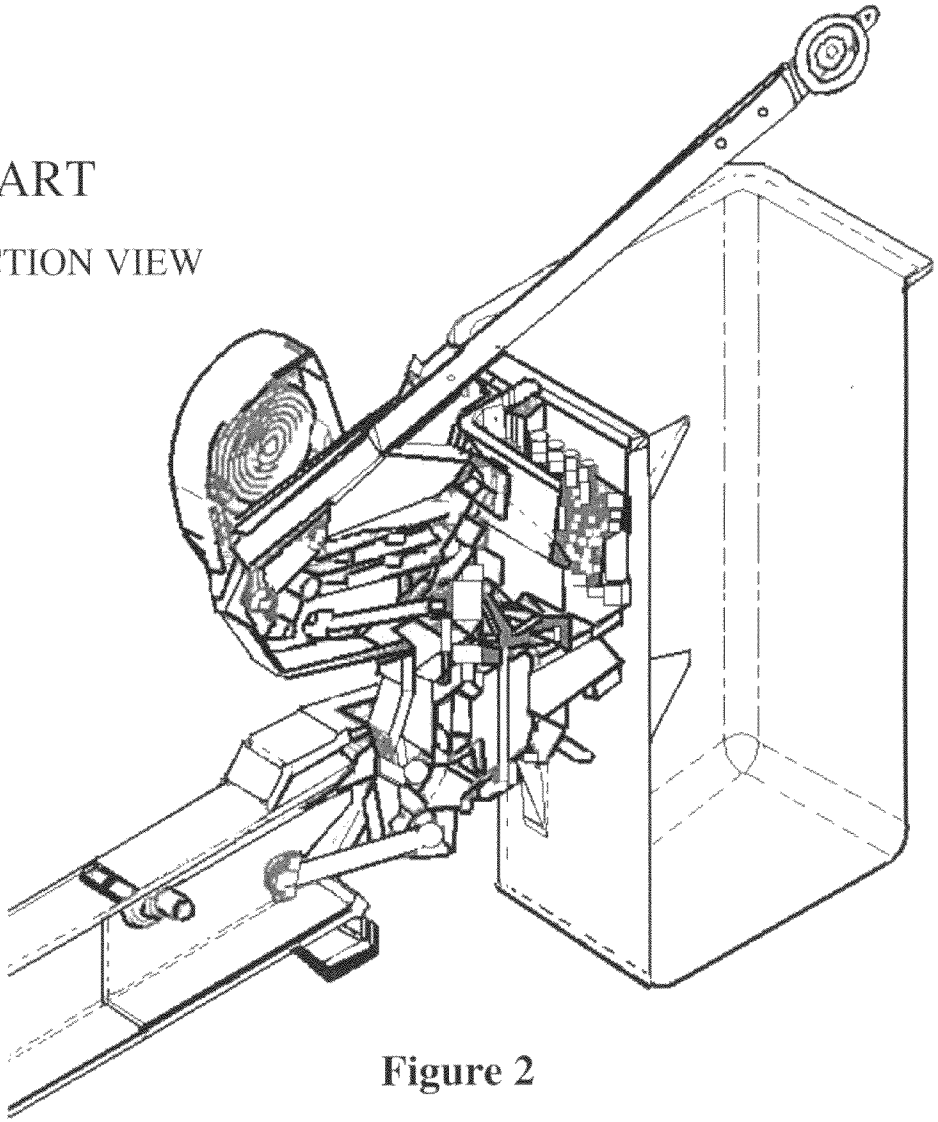
FIG. 2 shows a PRIOR ART section view of the assembly of FIG. 1.
Figure 3:
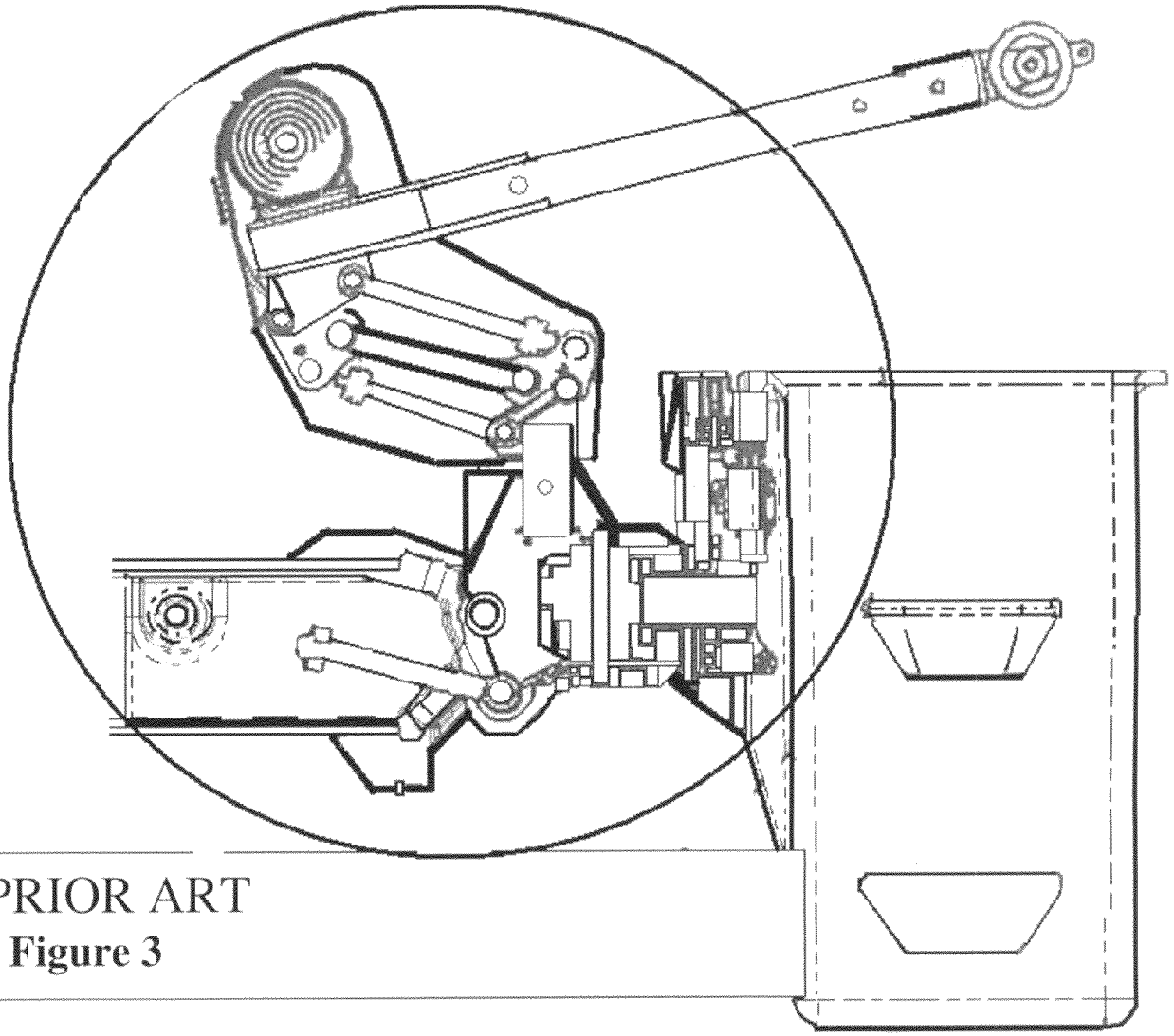
PRIOR ART Figure 3
FIG. 3 shows a side section view of the PRIOR ART assembly of FIG. 2 with indications of conductive components.
Figure 4:
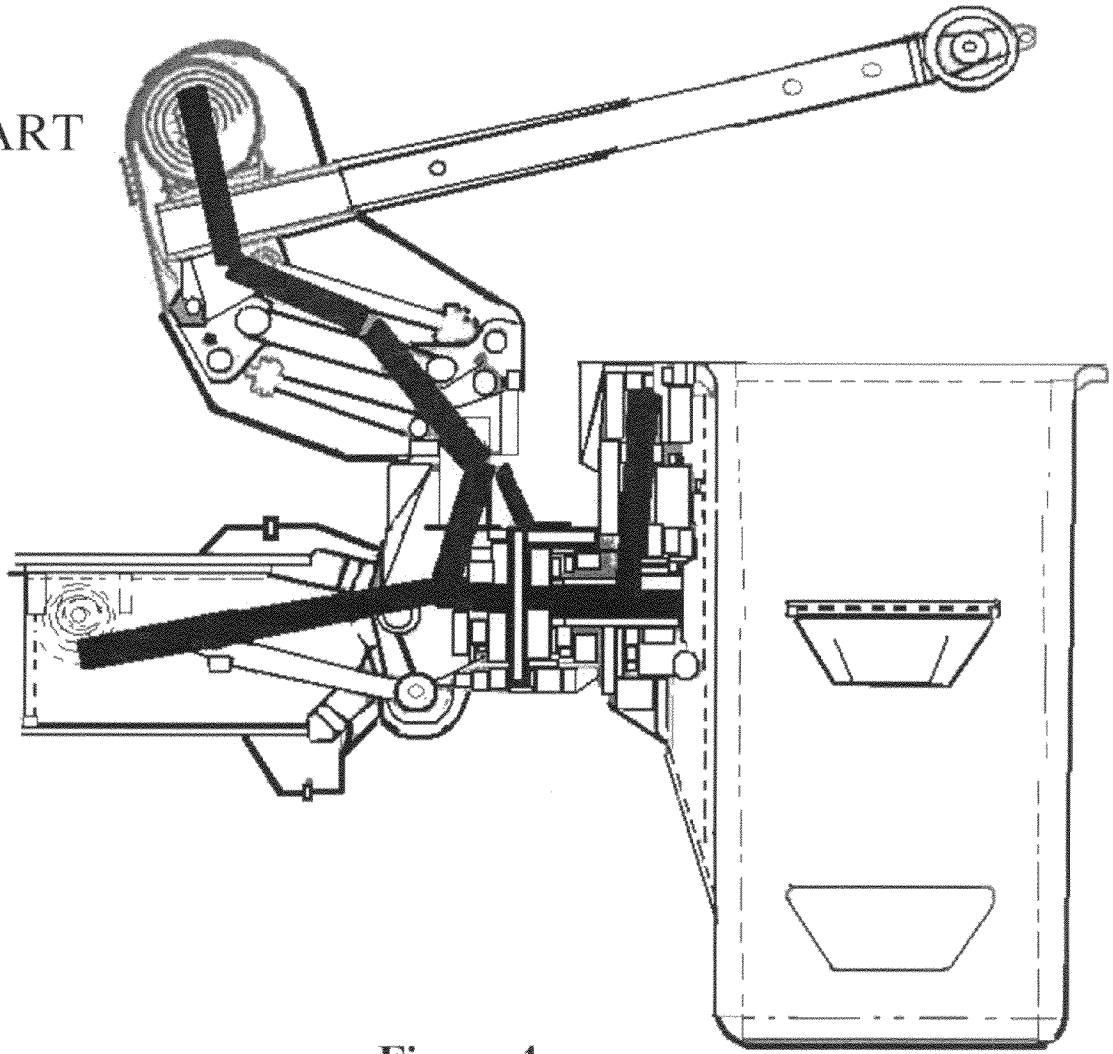
PRIOR ART Figure 4
FIG. 4 shows the side section view of PRIOR ART FIG. 3 with indications of the electrically conductive connections among the conductive components.

FIGS. 1-5 show PRIOR ART illustrations of an aerial platform assembly including a boomtip or leveling system, rotation system, jib or material handler, platform controls, and a platform. FIG. 1 shows a PRIOR ART perspective view of an aerial platform assembly. FIG. 2 shows a PRIOR ART section view of the assembly of FIG. 1. FIG. 3 shows a side section view of the PRIOR ART assembly of FIG. 2 with indications of conductive components. FIG. 4 shows the side section view of PRIOR ART FIG. 3 with indications of the electrically conductive connections among the conductive components; these conductive components are typically connected electrically and not isolated from each other or the rest of the platform assembly. While the prior art provides for insulated sections, much of the platform assembly after the boom is formed of a multiplicity of electrically conductive components, which creates a potentially unsafe condition for workers on the platform. Insulating the platform alone does not address the problem, since controls and functional connective components are still electrically conductive and could injure a worker on the platform. It is difficult to construct articulating components in a confined area, in particular past the boom tip and between the boom tip and the platform, and the platform area itself.

Figure 5:
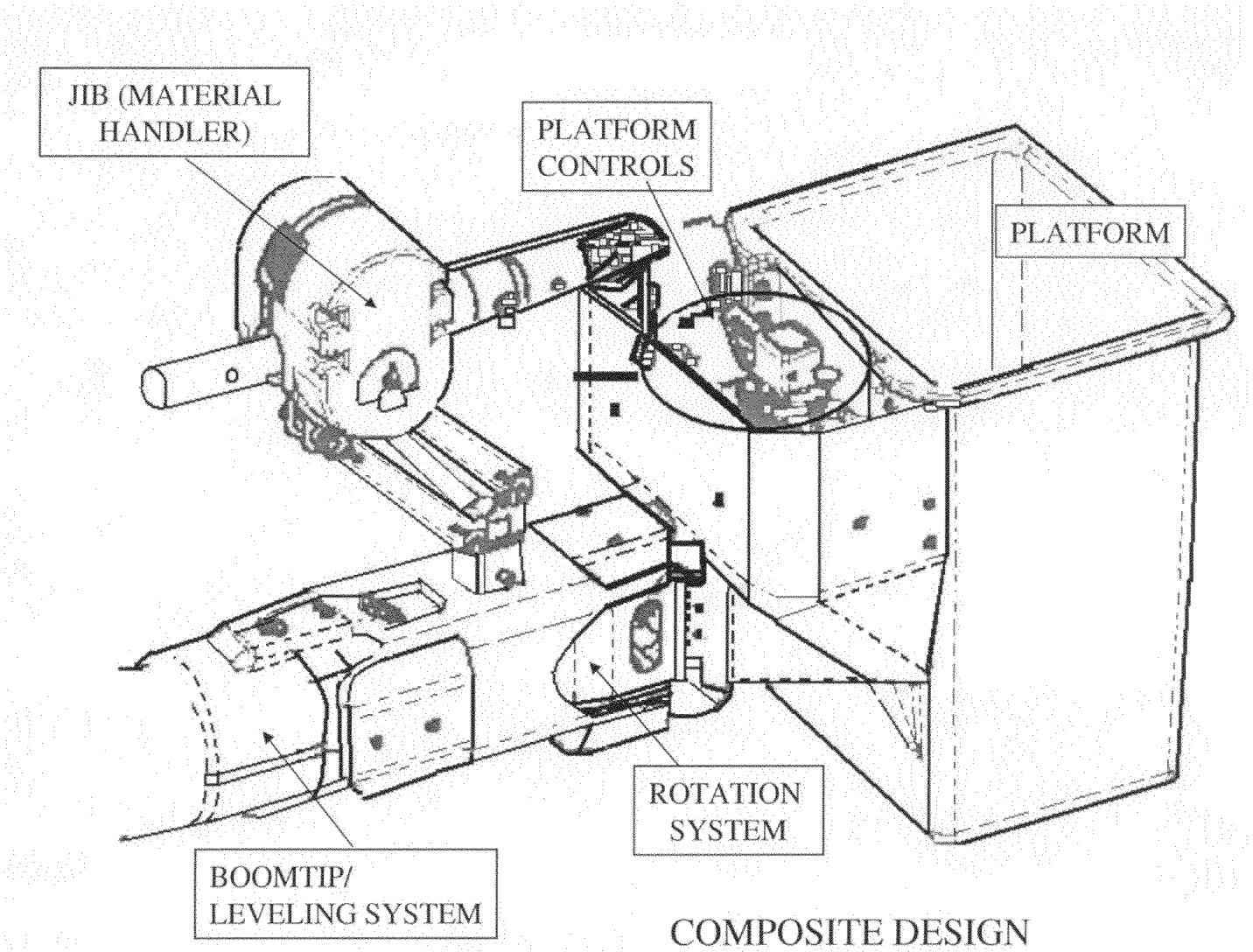
FIG. 5 shows a perspective view of a composite aerial assembly of an embodiment of the present invention.
Figure 6:
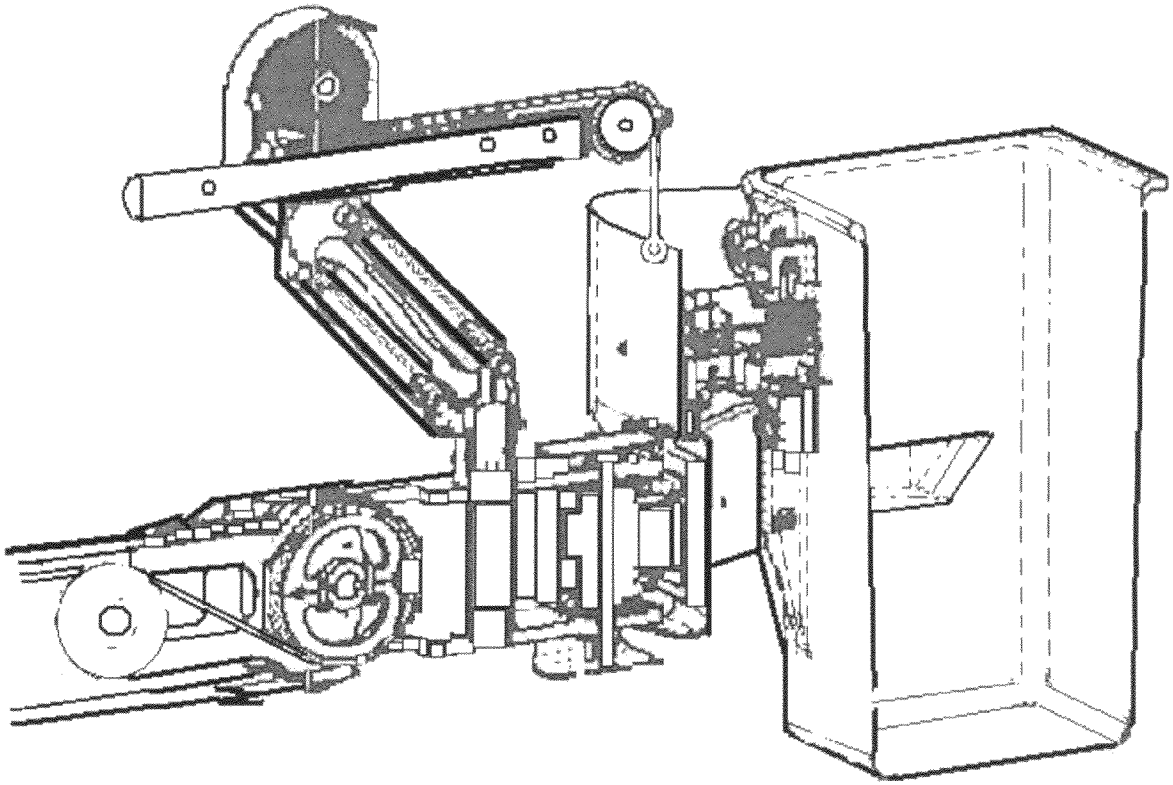
FIG. 6 shows a section view of the embodiment of FIG. 5.
Figure 7:
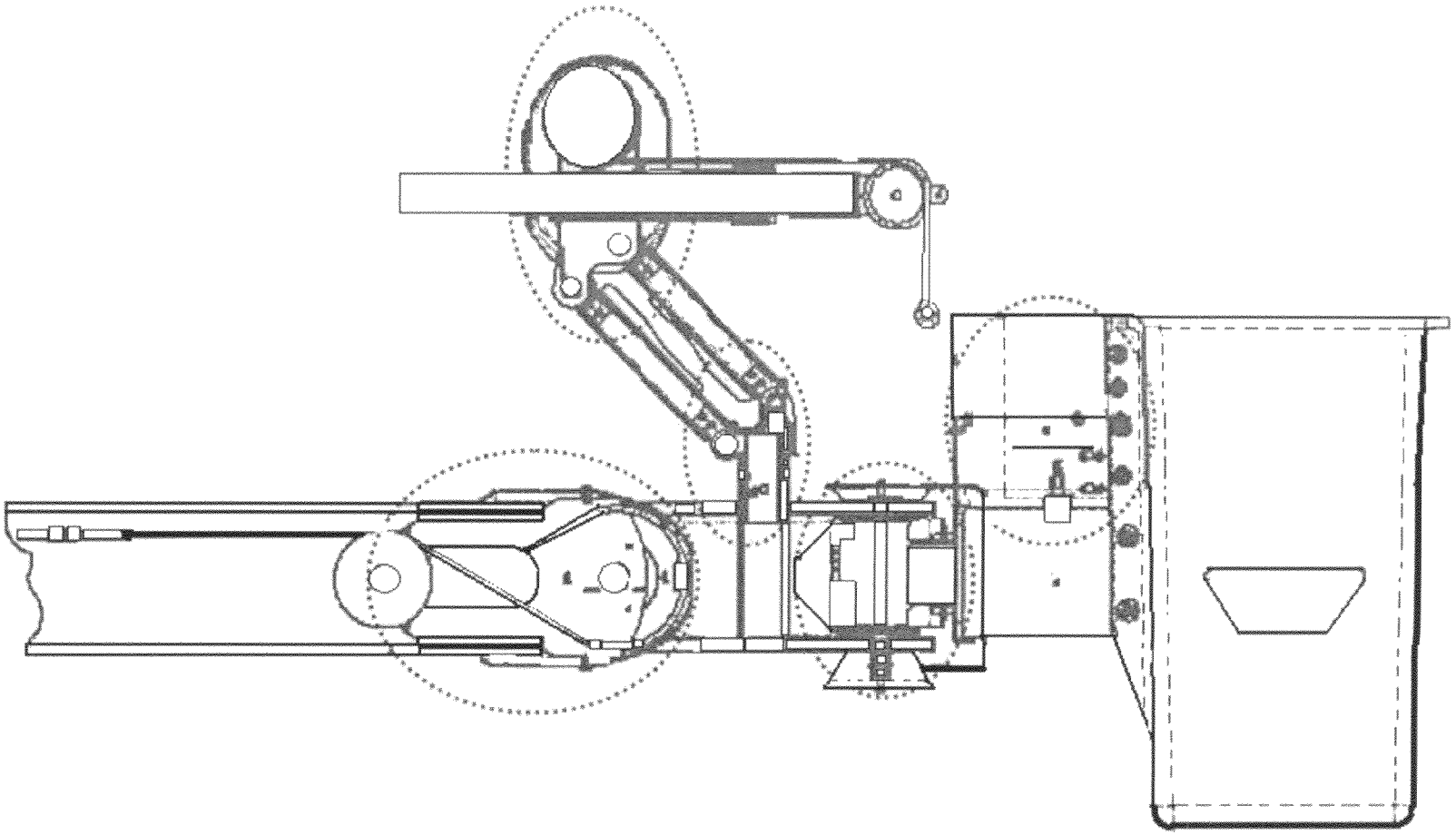
FIG. 7 shows a side section view of the embodiment of FIG. 6 with indications of conductive components being isolated or insulated to prevent electrical continuity.

Referring now to the present invention, which provides a vehicle-mounted or mountable aerial device including components having composite materials including a fabric-reinforced resin for providing electrically non-conductive assembly, by insulating and/or isolating conductive components for providing electrically non-conductive platform, controls, and other components and isolated conductive components, is illustrated in FIGS. 5-7.

FIG. 5 shows a perspective view of a composite aerial assembly of an embodiment of the present invention. FIG. 5 includes a boom tip and leveling assembly 12, a rotation system 14, a jib 16, a platform 18, and platform controls 20, together being components forming the assembly that are formed from composite materials. A description of preferred composite materials and other detail on components is set forth in US Patent Application Publication No. 20060175127, the entire application being made by the same inventor hereof and is incorporated herein by reference in its entirety. FIG. 6 shows a section view of the embodiment of FIG. 5, in particular illustrating the inside of the boom tip area of the aerial device assembly. As shown, the composite structures are provided to isolate and/or insulate conductive components to render the aerial assembly non-conductive. Furthermore, FIG. 7 shows a side section view of the embodiment of FIG.

6 with indications of conductive components being isolated or insulated to prevent electrical continuity, illustrated with dashed circular markings.

Significantly, the present invention provides for functional and conductive components of the aerial platform assembly, such as controls, to be isolated from the platform support and leveling system. By providing isolated proximal components, the aerial platform of the present invention includes at least one cluster of isolated components as illustrated in FIGS. 5-7. In a preferred embodiment of the present invention, the platform shaft, mounting bracket, and platform are formed from composite materials that are non-conductive. As indicated in the foregoing, the present invention provides for composite components and other solutions to completely insulate and/or isolate conductive components on the vehicular aerial platforms including controls, connectors, and other functional components. Such structural and functional components, such as connectors, had to be redesigned in the present invention to function the same or similarly but still be simple enough to form a composite component. Where selective replacement of a metal or conductive component is not made with a composite component(s), then insulation or isolation is provided as illustrated in the figures. The result of improvements of the present invention is that electrical pathways between conductive components are eliminated or minimized, thereby insulating or isolating each conductive component from each of the other conductive components. Preferably, the present invention provides for insulated aerial devices including but extending beyond the boom and platform being formed of composite materials, namely additionally insulating boom tip configurations and other functional components in between the boom and the platform so that everything is insulative, including moving pieces or components. Thus, by insulating the upper part of the boom structure as well as the boom and platform, risk and liability associated with electrical conductivity and injury to a worker on the platform are eliminated.

It will be appreciated that vehicle mounted and mountable aerial assemblies include basic components like a lower boom, an upper boom, a leveling system, a platform, controls, etc. Typically a steel system electrically connects the boom tip to the controls on the platform, platform rotation, and jib system. The present invention provides for insulation and/or isolation of all components associated with the assembly, including the upper boom with leveling system and shaft that extends out and is connected to the platform, thereby providing an assembly that is electrically non-conductive. Preferably, composite components and/or structures, such as fiberglass structures, encapsulate and insulate the system assembly. While fiberglass components do not replace all the metal structure, components, and pieces that attach to each other because of strength, weight, size, shape, etc., those that cannot be replaced by composites are reconfigured to include composite components to isolate them from any other conductive components on the assembly, as illustrated in FIGS. 5-7. As it is not possible to fully utilize the strengths of the composite materials in the same shape as metal components, most components and assemblies were completely redesigned for composite materials to minimize weight and maximize rigidity while maintaining insulation or isolation of conductive components. Change in the shape of some components is required in order to provide for molds for the composite components. Importantly, preferably, the geometries of such components are simple to facilitate composite fabrication.

While it is known in the art to provide for composite components for vehicular aerial platforms, it is not sufficient to simply only make composite parts to replace metal parts, in particular with functional components like connectors. Thus the prior art does not provide for providing composite components with other solutions to completely insulate and/or isolate conductive components on the vehicular aerial platforms including controls, connectors, and other functional components. Therefore, in the present invention, structural and functional components, such as connectors, had to be redesigned in the present invention to function the same or similarly but still be simple enough to form a composite component.

Certain modifications and improvements will occur to those skilled in the art upon a reading of the foregoing description. The above-mentioned examples are provided to serve the purpose of clarifying the aspects of the invention and it will be apparent to one skilled in the art that they do not serve to limit the scope of the invention. All modifications and improvements have been deleted herein for the sake of conciseness and readability but are properly within the scope of the claimed invention.

What is claimed is:

1. An aerial work assembly, positioned between and inclusive of a boom tip and a platform, wherein:

the aerial work assembly is comprised of basic components, said basic components including a boom tip, a platform, and a platform leveling system;

the basic components are each formed from electrically non-conductive materials or from a combination of electrically non-conductive materials and electrically conductive materials;

wherein any said conductive material is physically isolated from any other said conductive material, thereby preventing electrical conductivity from the conductive material of one basic component to the conductive material of any other basic component;

wherein select basic components are formed completely from electrically non-conductive materials, including composite materials, thereby rendering those said select basic components completely electrically non-conductive; and wherein the select basic components include the boom tip, and the platform leveling system, the boom tip being directly connected to the platform leveling system; thus an electrically non-conductive aerial work assembly from boom tip to platform is thereby created.

2. The assembly of claim 1, wherein the select basic components further include and a platform rotation system, the platform leveling system being directly connected to the platform rotation system.

3. The assembly of claim 1, wherein the select basic components further include a platform rotation system and a platform control system, the platform rotation system being directly connected to the platform control system.

4. An aerial work assembly, positioned between and inclusive of a boom tip and a platform, wherein:

the aerial work assembly is comprised of basic components, said basic components including a boom tip, a platform, and a platform leveling system;

the boom tip is formed completely from non-conductive materials, including composite materials;

the remaining basic components are each formed from electrically non-conductive materials or from a combination of electrically non-conductive materials and electrically conductive materials;

wherein any said conductive material is physically isolated from any other said conductive material, thereby preventing electrical conductivity from the conductive material of one basic component to the conductive material of any other basic component; and wherein each of the basic components is completely formed from electrically non-conductive materials, including 3-D woven, braided or knitted composite materials; thus an electrically non-conductive aerial work assembly from boom tip to platform is thereby created.

5. An aerial work assembly, positioned between and inclusive of a boom tip and a platform, wherein:

the aerial work assembly is comprised of basic components, said basic components including a boom tip, a platform leveling assembly, a platform rotation system, a platform, and a platform controls assembly;

the platform and the platform control assembly are and each being formed completely from electrically non-conductive materials, including composite materials, and the platform being directly connected to the platform control assembly;

the remaining basic components are each formed completely from electrically non-conductive materials or formed from a combination of electrically non-conductive materials and electrically conductive materials;

wherein any said conductive material is physically isolated from any other said conductive material, thereby preventing electrical conductivity from the conductive material of one basic component to the conductive material of any other basic component; and an electrically non-conductive aerial work assembly is thereby created.

6. The assembly of claim 5, wherein the basic components are further comprised of a basic component selected from the group consisting of a platform rotation system and a jib.

7. The assembly of claim 5, wherein each of the basic components is completely formed from electrically non-conductive materials, including 3-D woven, braided or knitted composite materials.

8. The assembly of claim 5, wherein at least one other basic component is formed completely from electrically non-conductive materials, including composite materials.

* * * * *